US008621973B2

(12) United States Patent
Abbe et al.

(10) Patent No.: US 8,621,973 B2
(45) Date of Patent: Jan. 7, 2014

(54) PORTABLE EXPLOSION CONTAINMENT CHAMBER

(75) Inventors: David C. Abbe, El Cajon, CA (US); John L. Donovan, Danvers, IL (US)

(73) Assignee: American Innovations, Inc., Chestnut Ridge, NY (US)

( * ) Notice: Subject to any disclaimer, the term of this patent is extended or adjusted under 35 U.S.C. 154(b) by 298 days.

(21) Appl. No.: 13/134,612

(22) Filed: Jun. 11, 2011

(65) Prior Publication Data

US 2012/0312147 A1 Dec. 13, 2012

(51) Int. Cl.
*F42B 33/06* (2006.01)

(52) U.S. Cl.
USPC ..... 86/50

(58) Field of Classification Search
USPC ..... 86/50; 70/113, 114, 117; 109/74, 80, 109/81, 61, 62, 59 R, 59 T, 26, 44, 49.5
See application file for complete search history.

(56) References Cited

U.S. PATENT DOCUMENTS

| | | | | | |
|---|---|---|---|---|---|
| 187,708 | A * | 2/1877 | Herman | 109/59 R |
| 398,611 | A * | 2/1889 | Hall | 70/114 |
| 662,435 | A * | 11/1900 | Hibbard | 70/114 |
| 1,104,765 | A * | 7/1914 | Baloun | 109/59 R |
| 1,929,341 | A * | 10/1933 | Wegner | 292/5 |
| 2,343,977 | A * | 3/1944 | Jones et al. | 292/5 |
| 3,820,435 | A * | 6/1974 | Rogers et al. | 89/1.1 |
| 4,147,044 | A * | 4/1979 | Bernath | 70/119 |
| 4,233,913 | A * | 11/1980 | Herrmann | 109/59 T |
| 4,468,943 | A * | 9/1984 | Beattie et al. | 70/302 |
| 4,754,715 | A * | 7/1988 | Squires | 109/59 T |
| 4,870,909 | A * | 10/1989 | Richter | 109/59 T |
| 5,535,637 | A * | 7/1996 | Baker et al. | 73/865.6 |
| 5,595,076 | A * | 1/1997 | Weinerman et al. | 70/208 |
| 5,911,763 | A * | 6/1999 | Quesada | 70/120 |
| RE36,912 | E | 10/2000 | Donovan | |
| 6,644,165 | B1 * | 11/2003 | King | 86/50 |
| 6,938,533 | B2 | 9/2005 | Holland et al. | |
| 7,281,309 | B2 | 10/2007 | Reynolds | |
| 7,343,843 | B2 | 3/2008 | Sharpe et al. | |
| 7,490,537 | B1 * | 2/2009 | Vande Brake | 86/50 |
| 7,506,568 | B2 * | 3/2009 | King | 86/50 |
| 7,765,910 | B2 * | 8/2010 | King | 86/50 |
| 8,222,624 | B2 * | 7/2012 | Yanke et al. | 250/506.1 |
| 8,276,527 | B2 * | 10/2012 | Stepp | 109/64 |
| 2007/0006723 | A1 | 1/2007 | Waddell, Jr. et al. | |
| 2008/0157541 | A1 * | 7/2008 | Olsen | 292/34 |
| 2008/0245978 | A1 * | 10/2008 | Yanke et al. | 250/515.1 |
| 2009/0019957 | A1 | 1/2009 | Eisenman et al. | |
| 2009/0044690 | A1 * | 2/2009 | King | 86/50 |
| 2010/0059695 | A1 * | 3/2010 | Yanke et al. | 250/506.1 |
| 2010/0300275 | A1 | 12/2010 | Warren | |

* cited by examiner

*Primary Examiner* — Jonathan C Weber
(74) *Attorney, Agent, or Firm* — George E. Bullwinkel

(57) ABSTRACT

A portable containment chamber for disposing of explosive threat devices comprises a cylindrical chamber body with a hinged interiorly convex outward-opening access door. The door closes against a tapered seat whereby explosion pressure enhances a gas-tight seal. In closed position the door is locked by interconnected expandable locking shoes which engage an annular locking channel in the mouth of the chamber with a simultaneous crank-and-piston linkage. The door is actuated by a pneumatic mechanism which first traverses laterally it into alignment with the chamber, then traverses it axially into sealing engagement with the chamber mouth, and then moves the expandable locking shoes into locked position. A first interlock prevents axial door movement when in standby position, and a second interlock inhibits detonation of a donor explosive charge within the chamber if the door locking shoes are not fully locked.

8 Claims, 6 Drawing Sheets

PORTABLE EXPLOSION CONTAINMENT CHAMBER

FIELD OF THE INVENTION

This invention relates to the containment of and safe disposal, including by controlled detonation, of explosive threat objects. Such objects may include improvised explosive devices (IEDs), suicide vests, pipe bombs, and suspicious packages of all kinds which may be discovered through various means including, but not limited to, x-ray imaging, trace explosives analysis, canine indications, or other explosives detection methodologies.

BACKGROUND OF THE INVENTION

An explosive threat device, once identified as either real or suspected, must be disposed of safely. At present this is commonly done by trained "bomb squad" explosives technicians who are required to dismantle the device and disable its operating components at great risk to themselves and their surroundings.

In addition, the level of equipment and technology available to bomb-makers, whether mentally disturbed persons or actual terrorists, is steadily advancing. In addition to the simple black-powder-and-fuse bombs of the past, bomb technicians must now deal with an increasing variety of explosives, whether commercial such as TNT, dynamite, and pentaerythritol tetranitrate (PETN), or homemade such as triacetone tri peroxide (TATP). These explosives are triggered by an equally expanding variety of initiation mechanisms ranging from simple time fuses to digital watches and cell phones wired to conventional blasting caps with ordinary nine volt batteries. Further, in every case the technician must confront the possibility that in a given threat device there may be more than one trigger mechanism, one of which might be designed to explode upon the mere opening or disassembling of the device.

For these reasons it has been recognized that the most direct and safe way to neutralize a suspected explosive threat device is to destroy it in a controlled explosion. In the past this has been done by transporting the threat to a remote area such as a gravel pit and detonating it there. This has the obvious disadvantages of requiring the threat object to be transported over public roads, and the resulting explosion generally creates a great deal of noise, smoke and flying debris.

A more sophisticated approach to the problem is to destroy the threat by exploding it within a sealed blast chamber using a small remotely detonated donor or booster explosive charge. If the threat device is small enough in terms of estimated weight of explosive, the chamber can be small enough to be carried to the site of the threat on a truck bed or wheeled carriage, which eliminates much of the danger of transporting the object from a public facility and over public roads to a remote location. This approach has been taught by Ohlson, US 2008/0314903 (published Dec. 25, 2008); King, U.S. Pat. No. 7,506,568 (Mar. 24, 2009); and King, U.S. Pat. No. 775,910 (Aug. 3, 2010). Larger, but non-portable, chambers are disclosed by Ohlsson, U.S. Pat. No. 4,478,350 (Oct. 23, 1984); Ohlsson, U.S. Pat. No. 4,632,041 (Dec. 30, 1986); Donovan, U.S. Pat. No. 6,354,181 (Mar. 12, 2002); and Ohlsson US 2990/0044693 (published Feb. 19, 2009).

A principal disadvantage of these prior art devices is that they are necessarily large and bulky because they rely for blast containment on a large internal chamber volume enclosed by a relatively thin spherical chamber body, often of aluminum. While providing greater physical volume can better contain and suppress a controlled detonation, it also requires a larger chamber opening. Such a large opening, while facilitating the loading of a threat device, necessarily results in a greatly increased door surface area. Thus the total separation force from a given internal explosion pressure are equally increased. When combined with relatively weak construction materials and unreliable door-sealing mechanisms, these prior art devices can become unreliable or even dangerous from a safety standpoint. Because of the stresses and deformation that necessarily accompany a detonation of any size (10 lb or TNT or more), certain of these aluminum-body spherical chambers are believed to be one-shot tools at best.

It is therefore a principal object of the invention to provide an improved portable blast-attenuating chamber which is strong, compact, repeatedly usable, and easily transported to the location of a suspected threat device where it can be quickly employed, preferably under remote control, to neutralize the threat either on the spot, or in a nearby safe location.

A further object is to provide a compact self-propelled blast-attenuating chamber capable of being moved quickly in and through the halls and doorways of public buildings, train stations and airports to the location of a suspected threat, and thereafter to a safe nearby area where the threat may be neutralized quickly and without undue danger to personnel or building structure.

Another object is to provide such a chamber with a closure door which is outward-opening for ease of inserting a threat object, and which can be positively locked to the chamber body with moveable locking shoes covering at least 270 degrees of door circumference. A related object is to provide such a door which extends convexly into the body of the chamber, such that it becomes self-tightening with increasing explosion pressures.

Yet another object is to provide a chamber and door in which all the elements of the locking mechanism are interconnected such that each element is mechanically constrained to lock simultaneously with the others, which together with an inhibition signal blocking means, prevents the initiation of detonation of a threat device unless the door is in a fully sealed and locked condition.

A more detailed object is to provide such a chamber and door in which the door is attached to the chamber body in a manner which permits opening and closing in a two-stage operation, with the door being swung into axial alignment with the chamber body in a first stage, and then traversed axially into engagement with the chamber opening in a second stage, whereupon the locking mechanism can be engaged. A related object is to provide self-contained pneumatic operating means for each stage of door operation such that the door must be correctly axially aligned with the chamber prior to insertion, and in which the locking mechanism cannot be actuated until full insertion is achieved.

SUMMARY OF THE INVENTION

The invention comprises a portable explosion containment chamber for safely disposing of suspected threat devices comprising a hollow chamber body and cylindrical chamber door preferably made of explosion-resistant impact-hardening manganese steel alloy, although other castable high-strength metals can also be used. The chamber door fits into an opening having an inwardly tapered, preferably stepwise, sealing surface.

The door itself has a convex surface facing the interior of the chamber, whereby internal pressures tend to expand the door into enhanced gas-tight sealing engagement. The mouth of the chamber, at the outside edge of the door, has an annular locking channel into which a plurality of expandable interconnected locking shoes are employed to lock the door in closed position. The locking shoes are commonly driven by a crank-and-piston linkage such that all the locking shoes must move in unison, thereby eliminating the chance that one shoe might be out of position after the door is closed and locked.

The invention employs remotely operated pneumatic door opening and closing mechanisms which operates in three stages. From a closed and locked position, the mechanism first retracts the locking shoes, freeing the door for axial movement. Next, the mechanism withdraws the unlocked door axially until it is free of the chamber mouth. At this point the door is free to be rotated over to one side, thereby providing clear access to the interior of the chamber. In closing and locking, the sequence of movements is reversed.

Preferably, pneumatic power means is utilized in each of the above steps, although hydraulic means or even hand operation may be employed to equal advantage. Pneumatic cylinders are employed to selectively move the locking shoes in and out of locking engagement with the internal annular locking channel in the mouth of the chamber, to translate the door axially in and out sealing engagement with the chamber body, and to move the disengaged door rotationally away from the chamber door opening to provide access for inserting a threat device, or removing the debris from an earlier controlled detonation.

For safety purposes, a first interlock means is provided to prevent axial opening and closing movement of the chamber door when in a standby position rotated away from the chamber mouth. A second interlock means prevents actuation of the locking shoes until the door is fully seated in the mouth of the chamber. A third interlock means inhibits detonation of a donor explosive charge within the chamber if all of the door locking shoes are not in fully locked position.

DESCRIPTION OF THE PREFERRED EMBODIMENT

Figure 1:
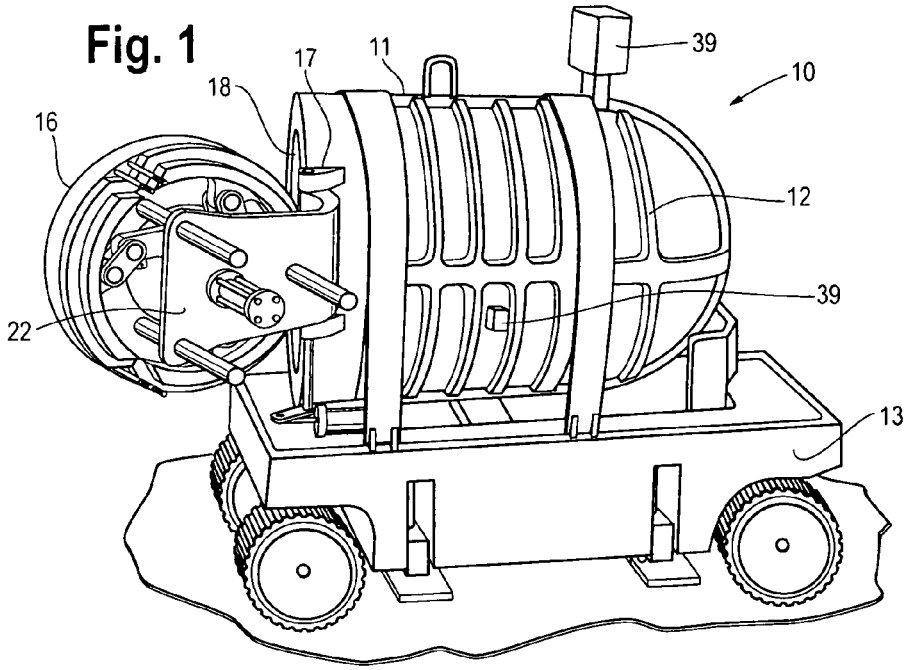
FIG. 1 is a perspective of the improved portable explosion containment chamber of the present invention, with the chamber door in standby position rotated away from the chamber central axis.

Turning to the drawings, FIG. 1 illustrates in perspective view the improved portable explosion containment chamber assembly 10 of the present invention. In the preferred embodiment, the chamber body 11 is a unitary hollow casting, preferably of impact-hardening manganese alloy steel alloy, with cast-in external stiffening ribs 12. The advantage of manganese alloy steel is that its surface becomes harder and stronger with the impact of each detonation. In the illustrated embodiment the ribs 12 are circumferential, but they may also be arranged in a cross-hatched or waffle pattern for additional strength.

The chamber assembly 10 is mounted on a self-powered transporter 13 propelled, or by a self-powered transporter (not shown) which can be connected to the dolly with an articulated hitch, making it easily steerable. The transporter 13 may be propelled by any suitable means, such as electric batteries or a small gasoline engine and has manual controls operated from a position safely opposite the opening end of the chamber. The explosion products from the detonation may be vented through a baffled vent 39 either immediately, or after cooling and testing to determine that they do not present a fire or environmental hazard.

According to the invention, the chamber, dolly and transporter are sufficiently compact such that the entire assembly has a width, length and weight which will allow the device to be transported in freight elevators, through corridors, and through doorways throughout the device's intended operating environment. Optimally, the device has a width under 36 inches, a maximum length of six feet, and a weight of under 5000 lbs for full operational mobility within airports and other public buildings. Similarly, the wheels of the dolly 13 and transporter 15 are desirably fitted with narrow pneumatic rubber tires of 15 inches diameter or greater to allow relatively easy movement over door sills and the like.

Figure 2:
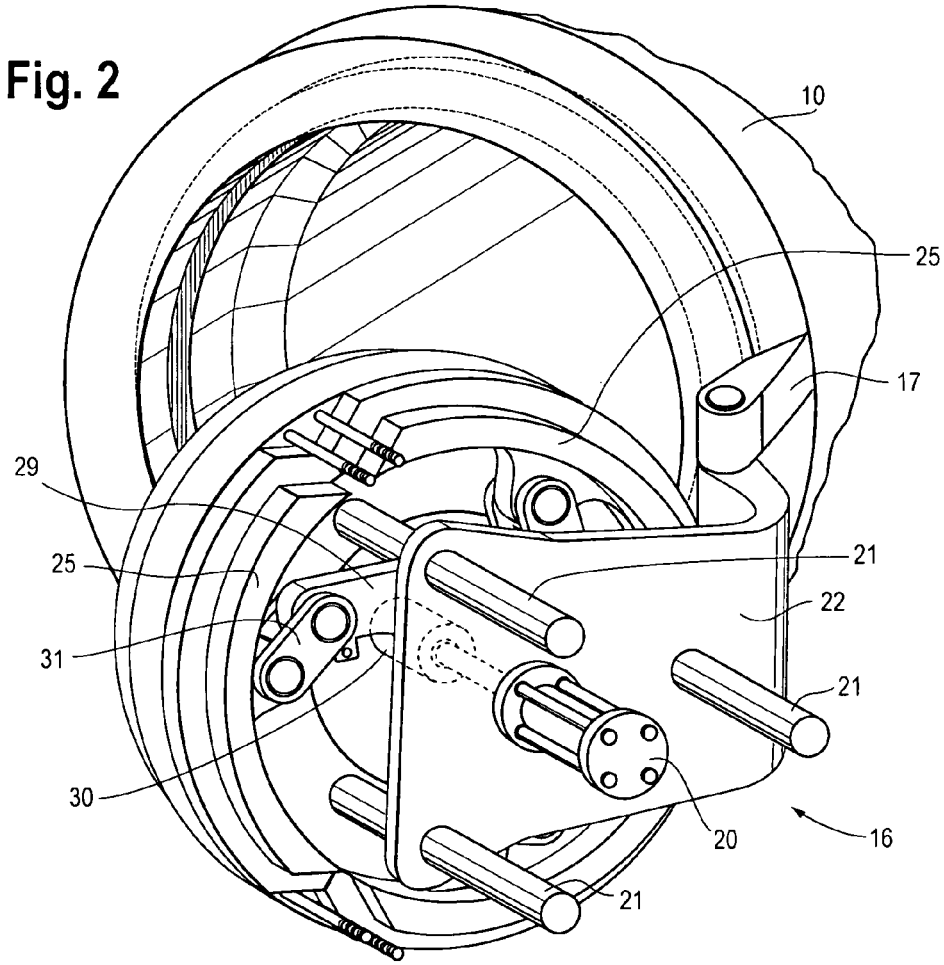
FIG. 2 is a partial perspective of the chamber door and hinge mechanism, illustrating the axial translation means for moving the door in and out of engagement with the chamber mouth.

As best shown in FIGS. 1 and 2, the chamber body 11 is closed by a door assembly 16 suspended by a side-mounted hinge 17, which permits the relatively heavy door assembly to easily swing on a horizontal plane in and out of axial alignment with the chamber. The door itself, like the chamber body, is preferably of impact-hardening cast manganese steel.

As a feature of the invention, the door assembly 16 is suspended from the hinge 17 in a manner so as to allowing it to be inserted and withdrawn from the chamber mouth 18 in two sequential movements. In fully open position (FIGS. 1,4) the door assembly 16 is positioned away from the chamber access and to one side, allowing direct access to the chamber mouth 18 for insertion of a threat device (not shown), while in fully closed position (FIG. 5) the door assembly is axially aligned with the centerline of the chamber 11 for ease of insertion and withdrawal.

The sequence of operation is as follows. Starting with the door in standby position, fully open and rotated away from the chamber central axis (FIGS. 1 and 4), a threat device and detonation initiator 40 are placed within the chamber 11 by suitable means, such as a remotely operated robot carrier or bomb squad personnel wearing protective gear. In practice, a small electrically operated explosive charge (not shown) is attached to the threat device, having an initiator capable of triggered remotely by any suitable means, such as radio control or an electrical feed-through terminal 39 in the chamber wall.

To position the threat device and initiator the chamber body 11 may be provided, for example, with a string mesh hammock (not shown). If desired, plastic bags of water (not shown) may also be placed into the chamber with the threat device and initiator to help attenuate the explosive energy, in the way taught by Donovan Re. 36,912. In practice, the mass of explosive (in TNT equivalent) is preferably matched by an equal mass of water suspended within the chamber for optimum attenuation effect. The bottom of the chamber may also be lined with a layer of granular shock absorbing material such as pea gravel or the like (not shown), as taught by Donovan Re. 36,912 and Donovan U.S. Pat. No. 6,354,181.

Figure 5:
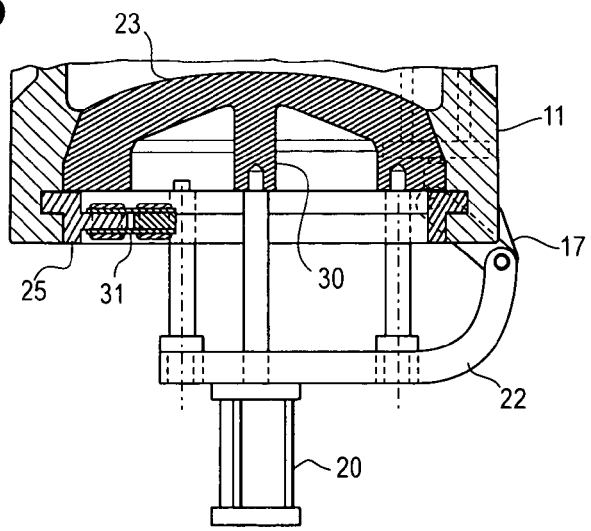
FIG. 5 is a detail of the sectional plan view of FIG. 4 showing the door in closed position.
Figure 6:
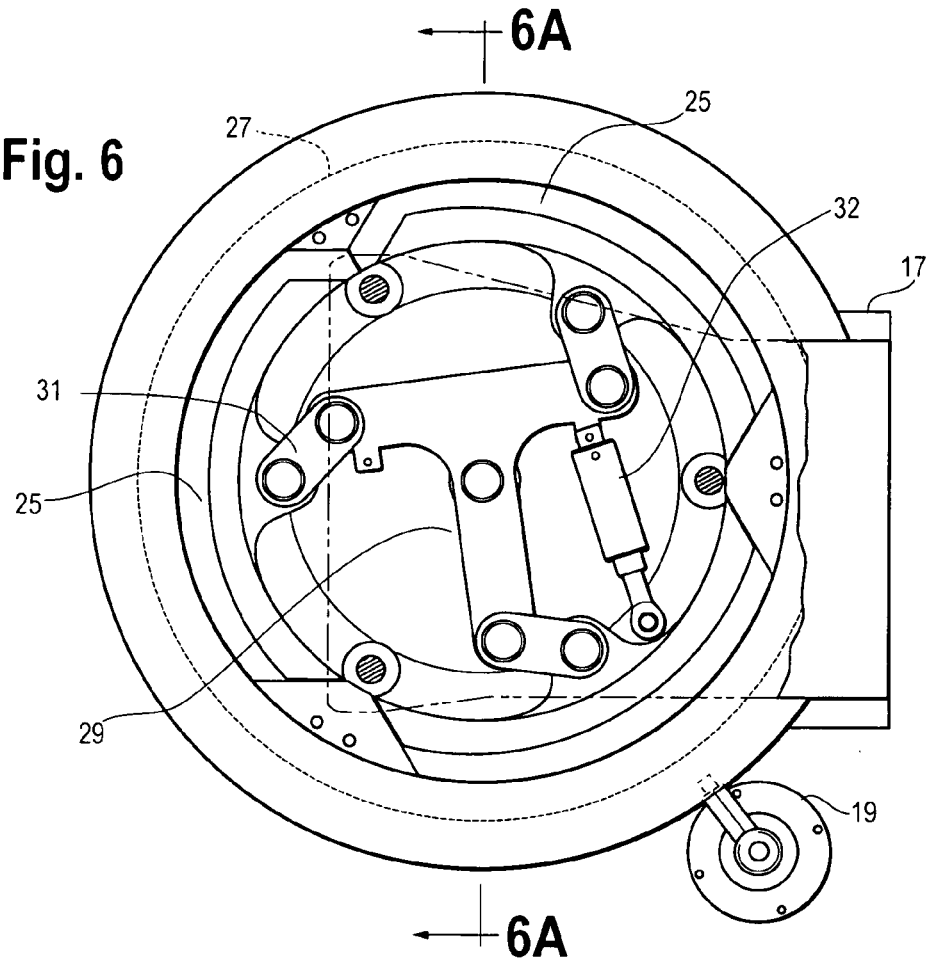
FIG. 6 is a schematic elevation view of the pneumatically-operated door locking shoe actuation system of FIG. 3 showing the locking shoes in a retracted (door openable) position from their corresponding locking channel in the chamber body.
Figure 6A:
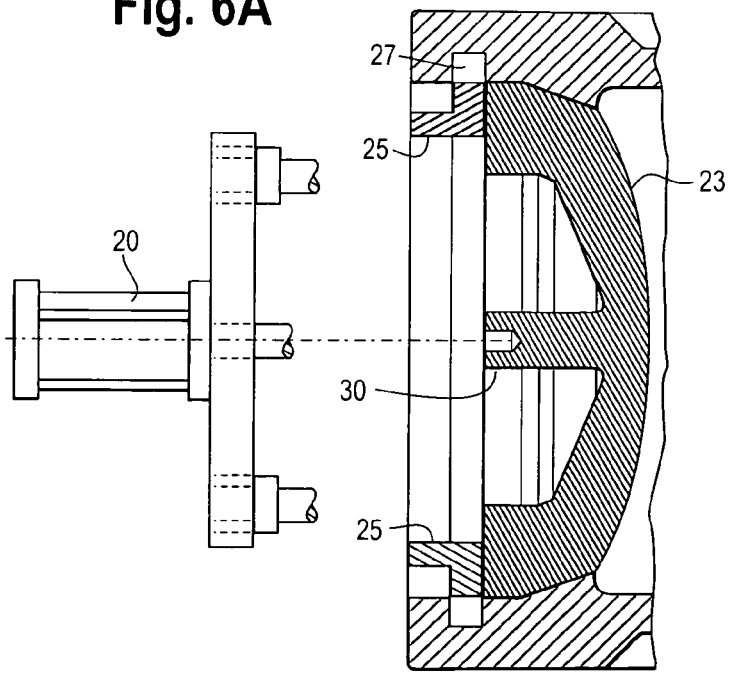
FIG. 6A is a sectional partial side elevation of the door locking system of FIGS. 3 and 6 showing the locking shoes in retracted position.
Figure 7:
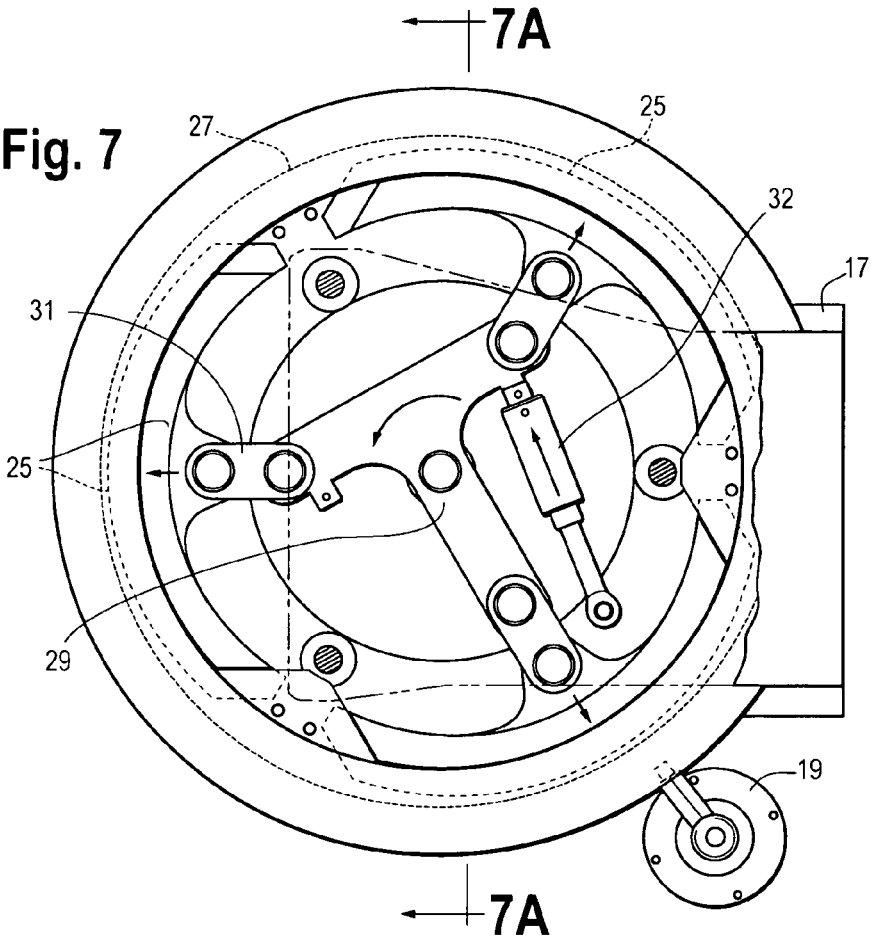
FIG. 7 is a sectional partial side elevation similar to FIG. 6 showing the mechanical interconnection of the individual locking shoe connecting rods with the central locking crank, and pneumatic power means for simultaneous engagement of the locking shoes. The locking shoes are shown in extended (locking) position engaged with a corresponding circumferential locking channel in the chamber body.
Figure 7A:
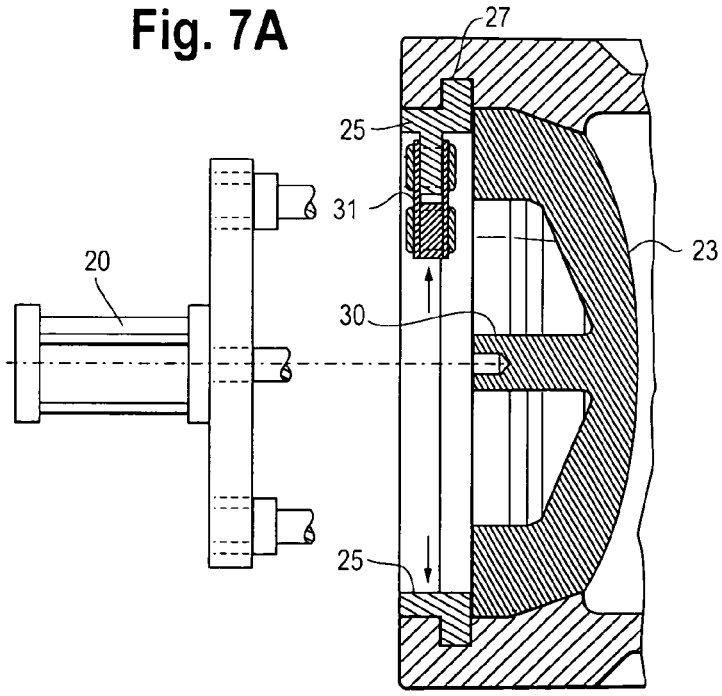
FIG. 7A is a sectional partial side elevation of the door locking system of FIGS. 3 and 7, again showing the locking shoes in engaged position.

With the threat device and initiator properly placed within the chamber body 11, the door assembly 16 is closed in two discrete steps. In the first step, the door is swung about its hinge 17 in a horizontal plane into alignment with the central axis of the chamber 10 (FIGS. 2 and 5). This may be accomplished by hand, or preferably by a first remotely actuated pneumatic closing means 19.

When the door assembly 16 is correctly aligned with the chamber central axis, in the second step it is translated axially into the chamber mouth 18 by a second remotely actuated closing means 20. The door assembly 16 is supported and guided for in-and-out axial movement by three guide pins or rods 21 ("Thomson rods") carried in spaced parallel array by the hinge plate 22, along with the second pneumatic door actuating means 20 (FIGS. 4-5).

Figure 3:
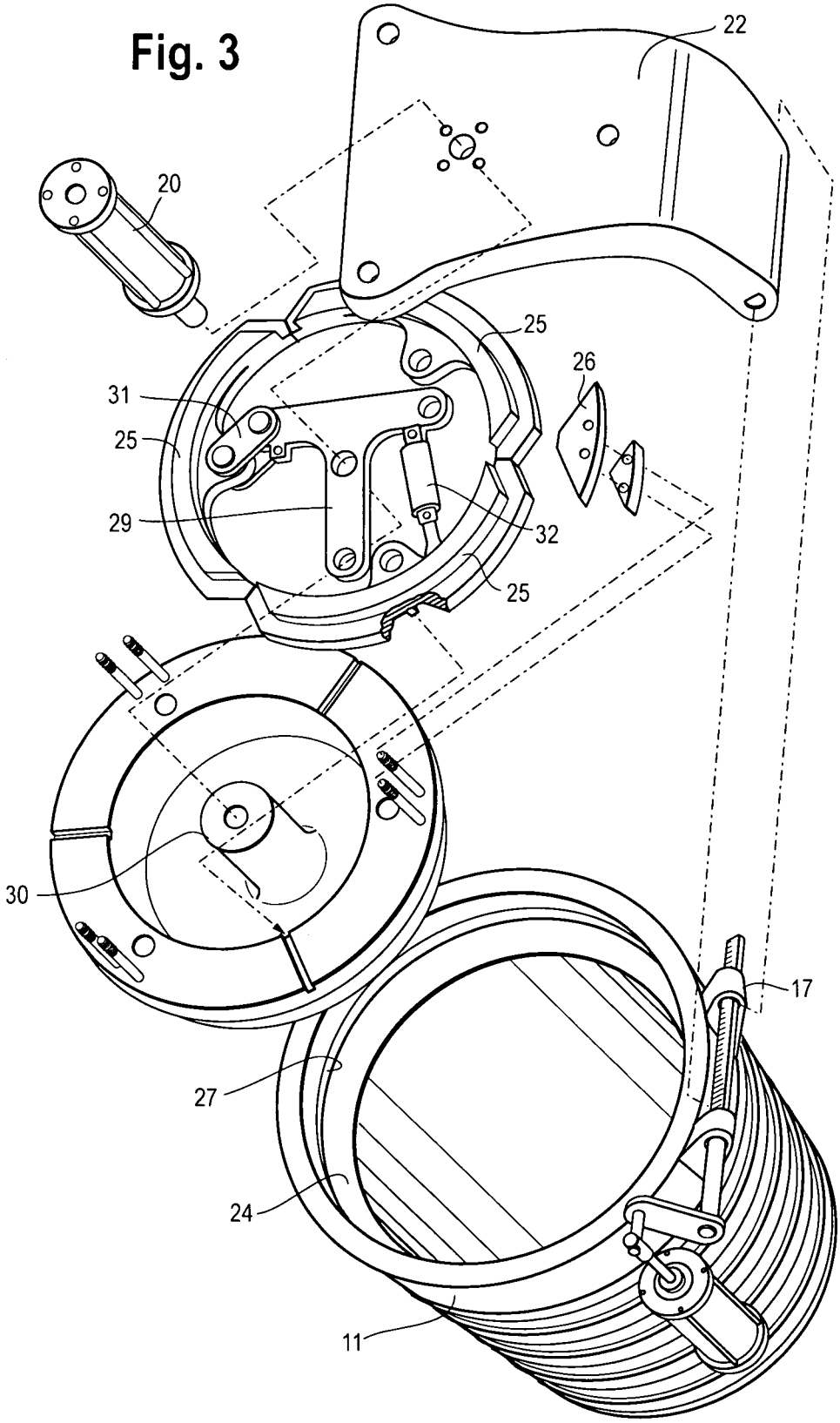
FIG. 3 is an exploded partial perspective of the pneumatically-operated door locking shoe actuation system of the invention.

As is best shown in the exploded view of FIG. 3 and sectional elevations of FIGS. 5-7A, the door assembly 16 comprises three major components. The first component is the door 23, again preferably a manganese steel casting, which projects convexly into the chamber body 11 (FIGS. 4-5). The door 23 is machined to fit snugly into a corresponding step-tapered seat 24 within the chamber mouth 18.

Figure 4:
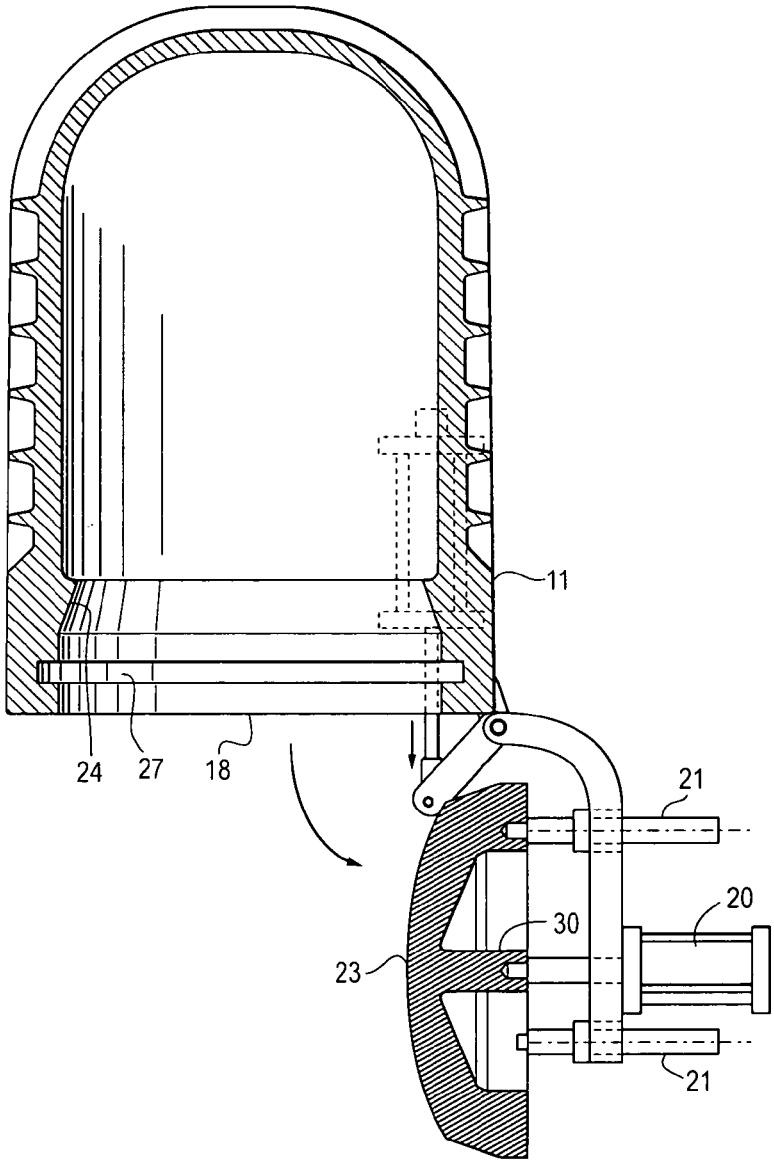
FIG. 4 is a sectional plan view of the chamber showing the door in open position.

The second component group comprises three movable locking shoes 25 which are constrained at their edges by hold-down wedges and retainers 26 for radial in-and-out movement, whereby each shoe may slide outward to engage a corresponding annular locking channel 27 machined into the inner surface of the chamber mouth 18 (FIGS. 4-5). The illustrated embodiment has three locking shoes 25, each of which engages the locking channel 27 over an arc of at least 90 degrees, for a combined arc of circumferential engagement of at least 270 degrees. The invention is not confined to the use of three shoes, and four or more may also be utilized, with corresponding smaller individual arcs of engagement.

The third component group is a crank-and-piston linkage 28 (FIGS. 3, 6 and 7) comprising a crank element 29 pivoted to a central boss 30. The crank element connects to each of the axially slidable locking shoes 25 by over-center link elements 31, much like the crank-and-piston arrangement of an automobile engine.

To lock the door assembly 16 into explosion-resistant contact with the tapered seat 24, the crank element 29 is rotated by a third remotely actuated pneumatic means 32 (FIGS. 2, 6-7) which simultaneously drives each of the locking shoes 25 into over-center locking engagement with the annular locking groove 27. Once in locked position, and like an automobile engine crankshaft, connecting rod and piston at TDC (Top Dead Center), the locking shoes 25 are incapable of disengagement unless and until the crank 29 is rotated past TDC, thereby rotating the links 31 away from direct alignment with the crank central axis.

As another feature of the invention, the corresponding mating edges of the locking shoes 25 and locking groove 27 are beveled to cooperate in a wedging action when the shoes are simultaneously fully engaged, whereby the door 23 is locks and sealed firmly against its tapered seat 24.

Because the door 23 projects convexly into the chamber 10, and as an additional feature of the invention, the pressure wave from a detonation within the chamber body 11 tends to flatten and broaden the convex casting, further increasing the pressure holding the door 23 against the seat 24 and further enhancing the seal. The invention is not confined to the use of a convex door, however, and a properly designed flat door may also be employed. If desired, to accommodate minor dimensional misalignments, either the door 23 or seat 24 may also be provided with a circumferential heat-resistant silicone o-ring or a labyrinth seal (not shown).

Figure 8:
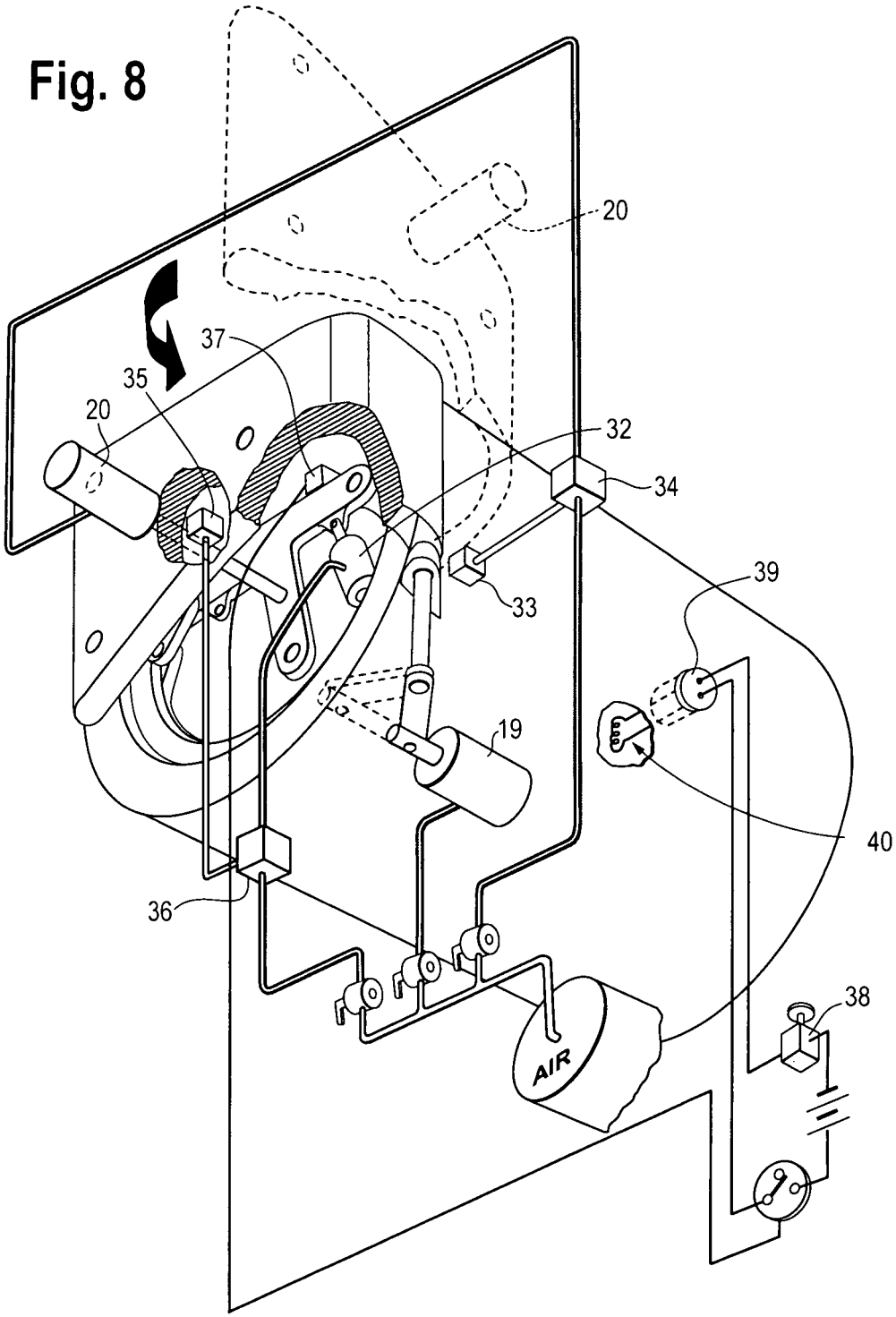
FIG. 8 is a schematic diagram showing a first interlock means for preventing axial opening and closing movement of the chamber door when in standby position rotated away from the chamber mouth, a second interlock means for preventing the actuation of the locking shoes until the door is fully seated against the chamber opening, and a third interlock means for inhibiting detonation of a donor explosive charge within the chamber if the door locking shoes are not in fully locked position.

As a further feature of the invention, and as best shown in FIG. 8, first and second interlock means are provided to prevent mechanical interference of the door assembly 16 with the chamber mouth 18 during opening and closing the chamber, and also to inhibit the electrical triggering of an initiating charge within the chamber unless all of the locking shoes are in a simultaneously fully locked position.

To assure that the door assembly 16 is properly aligned with the central axis of the chamber 10 for axial in-and-out movement, a first position sensor 33, such as a microswitch, optical position sensor or the like (FIG. 8) is provided to indicate the relative position of the hinge body 22 and door assembly 16 to the chamber body 11. When the door assembly is properly aligned with the chamber central axis for axial in-and-out movement, position sensor 33 disinhibits (allows) the actuation of a first pneumatic control interlock 34. The first interlock 34 has two functions. First, it inhibits the first door-closing pneumatic means 19 against unintended withdrawal of the door assembly 16 from its aligned in-and-out position, and second, it simultaneously disinhibits (releases) the second remotely-operated pneumatic closing means 20 to move the door axially in and out of sealed position.

At the point when the door 23 is fully engaged with its tapered seat 24, a second position sensor 35 disinhibits (releases) a second interlock means 36 to permit actuation of the third remotely actuated pneumatic means 32, which is then enabled to simultaneously drive the locking shoes 25 into locking position. A third position sensor 37 (FIG. 8) detects when all of the shoes 25 are in locked position and sends a signal to disinhibit (permit closure of) the connection between an electrical detonation initiation means 38 and the initiation charge of the threat object which is now sealed within the chamber. The threat object may then be instantly and safely detonated and thus neutralized.

The invention claimed is:

1. A containment chamber for disposing of explosive threat devices having a door-carrying chassis and a two-stage door opening and closing mechanism, comprising:

a hollow chamber body of explosion-resistant metal enclosing a detonation space and having a central axis and a cylindrical access opening disposed thereon, said access opening tapering inwardly toward the interior of said chamber;

a chamber door of explosion-resistant metal being positionable within said access opening for closing said opening, said door tapering inwardly to cooperate with said access opening to create a gas-tight fit and seal with said chamber body;

said chamber body having a locking channel adjacent said cylindrical access opening and enclosing said door when said door is in closed position;

said door having at least one locking shoe for selectively engaging and disengaging said annular locking channel to thereby lock and unlock said door against opening movement;

a crank link rotatable about said chamber central axis and connected to said locking shoe by a pivoted connecting link, whereby the combination of said crank link, connecting link and locking shoe forms a crank-and-piston assembly, wherein upon full engagement of said locking shoe with said locking channel said crank-and-piston assembly is in a substantially top-dead-center position, thereby immobilizing said locking shoe until said crank link is moved away from said position, an axial translation component including at least one guide post on said door cooperating with a guide channel in said chassis for in-and-out movement of said door relative to said chamber access opening, an angular translation component including a hinge means for connecting said chassis with said chamber body and for swinging said chassis and door away from said chamber central axis when said door is in a withdrawn position, first interlock means for preventing axial translation of said door if said door is not correctly aligned with said chamber central axis for opening and closing, and second interlock means for preventing angular translation of said door if said door is not substantially fully withdrawn from said chamber access opening.

2. The explosion containment chamber of claim 1 having power means for actuating and controlling each of said crank-and-piston assembly, the axial translation component and the angular translation component from a remote location.

3. The explosion containment chamber of claim 1 in which said power means includes at least one pneumatic actuator powered from a self-contained source of compressed gas.

4. The explosion containment chamber of claim 1 in which said power means includes at least one hydraulic actuator powered from a self-contained source of hydraulic pressure.

5. The explosion containment chamber of claim 1 in which:

said chamber body has an electrical feed-through port for passing an electrical impulse to the detonator of an explosive donor charge within said chamber body;

said crank-and-piston assembly includes a position sensing means for generating a locked-and-safe signal indicating that said locking shoe is fully engaged with said locking channel; and electrical interlock means for inhibiting the sending of said electrical impulse in the absence of said locked-and-safe signal.

6. The explosion containment chamber of claim 1 in which the explosion-resistant metal is impact-hardening manganese steel alloy.

7. The explosion containment chamber of claim 1 having three locking shoes disposed at approximately 120 degrees from each other.

8. The explosion containment chamber of claim 1 in which said door is spherically convex in the direction of the interior of said chamber body, whereby increasing explosion pressure within said chamber tends to expand said door into enhanced sealing engagement with said access opening.

* * * * *